US005219208A

United States Patent [19]

Liao et al.

[11] Patent Number: 5,219,208

[45] Date of Patent: Jun. 15, 1993

[54] SCRUBBER FOR DISPERSING DUST GENERATED BY LONGWALL SHEARERS

[75] Inventors: Chung F. Liao, Kingwood, Tex.; George W. Graham, Wilkinson, W. Va.

[73] Assignee: Zeigler Coal Holding Company, Fairview Heights, Ill.

[21] Appl. No.: 861,407

[22] Filed: Mar. 31, 1992

[51] Int. Cl.[5] ..... E21C 35/22

[52] U.S. Cl. ..... 299/12; 261/116; 299/43

[58] Field of Search ..... 299/12, 43, 64; 239/433; 261/115, 116

[56] References Cited

U.S. PATENT DOCUMENTS

| | | | |
|---|---|---|---|
| H23 | 2/1986 | Riester et al. | 299/12 X |
| 4,068,802 | 1/1978 | Goings | 261/116 X |
| 4,351,567 | 9/1982 | Gillingham | 299/12 X |
| 4,358,160 | 11/1982 | Kissell et al. | 299/12 X |
| 4,552,487 | 11/1985 | Weirich | 299/12 X |
| 4,555,059 | 11/1985 | Collins et al. | 239/433 X |
| 5,145,236 | 9/1992 | Liao et al. | 299/64 X |

FOREIGN PATENT DOCUMENTS

| | | | |
|---|---|---|---|
| 2828980 | 1/1980 | Fed. Rep. of Germany | 299/12 |

OTHER PUBLICATIONS

"Reducing Longwall Face Workers' Respirable Dust Exposure From Roof Support Movement", Bureau of Mines, Technology News, No. 205, Aug. 1984.

"Ventilation Curtain reduces Dust from Cutting into Longwall Entry", Bureau of Mines, Technology News, No. 137, Mar. 1982.

"Reduce Dust on Longwall Faces with a God Curtain", Bureau of Mines, Technology News, No. 119, Nov. 1981.

"Modified Cutting Sequence Reduces Longwall Shearer Operators' Dust Exposure", Bureau of Mines, Technology News, No. 116, Nov. 1981.

"Spring-Mounted Screens on Shearer Reduce Operators' Dust Exposure", Bureau of Mines, Technology News, No 121, Dec. 1981.

Report of Investigations 9037, "Using Barriers to Reduce Dust Exposure of Longwall Face Workers", Jankowski et al, Bureau of Mines, 1986.

Technical Progress Report 111, "Reducing Dust at Longwall Shearers by Confining the Dust Cloud to the Face", by Kissell et al, Bureau of Mines, Feb. 1981.

*Primary Examiner*—David J. Bagnell

*Attorney, Agent, or Firm*—Polster, Lieder, Woodruff & Lucchesi

[57] ABSTRACT

An air scrubbing system for removing dust produced by longwall shearers from the operator's work area. The system uses a plurality of small scrubbing units mounted on the shearer. Each of the scrubbing units utilizes a series of twin fluid atomizers located at the inlet of the unit to produce a fine water mist for capturing the respirable dust. The scrubbing units return the dust-laden mist to the coal face.

9 Claims, 2 Drawing Sheets

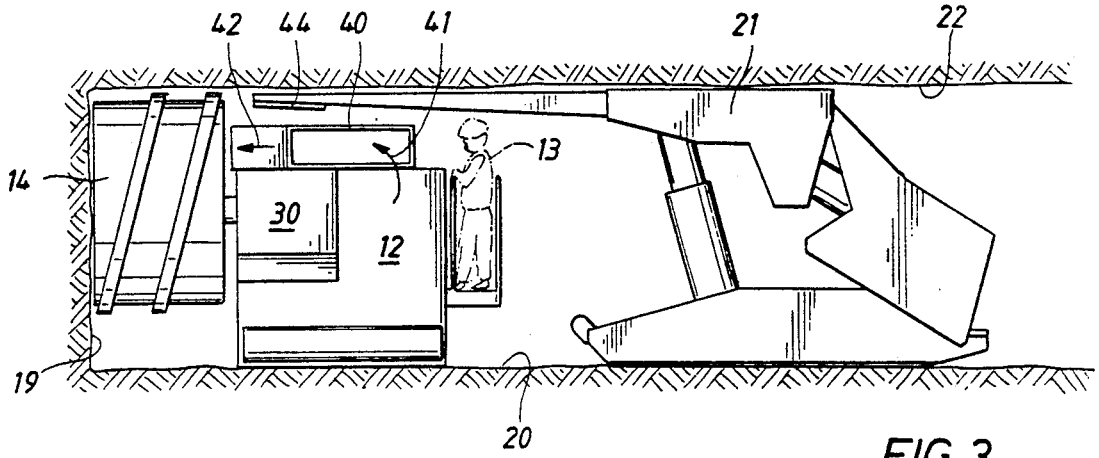
FIG. 3
FIG. 4
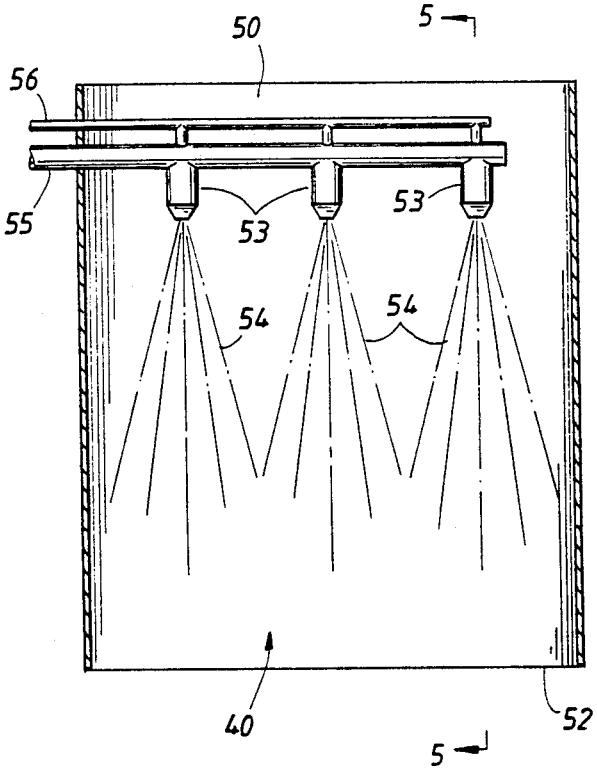
FIG. 5
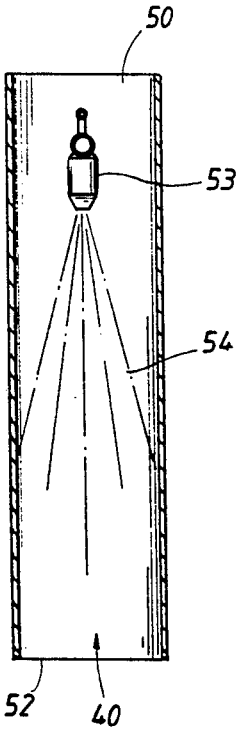

SCRUBBER FOR DISPERSING DUST GENERATED BY LONGWALL SHEARERS

BACKGROUND OF THE INVENTION

The present invention pertains to the mining of coal and particularly to the use of longwall shearers in mining operations. Longwall shearers refers to continuous miners in which two rotating drums, referred to as the head drum and the tail drum, are used to shear the coal from a coal face that extends laterally from an access gallery in an underground mine. The shearer moves along the coal face cutting the coal from the face in one direction and then returns in the opposite direction when it completes cutting the coal from the face. As the shearer advances temporary roof supports or shields are moved forward to support the roof in the area where the coal has been removed. The section of the mine behind the temporary supports is allowed to collapse.

As can be readily appreciated, the operation of longwall shearers produces a large quantity of dust that must be contained in order for operators to function in the vicinity of the shearer. The dust is partially contained by an air flow which flows from the gallery into the lateral opening along the coal face. This air flow tends to circulate and force the dust toward the end of the lateral area, but in so doing, causes the dust to flow around the operators who are positioned on the shearer between the two rotating drums. Present Federal standards set a dust limit of 2 milligrams per cubic meter for mine operations and very few high production longwall shearers meet this Federal standard.

The prior art as described in an article entitled "Reducing Dust at Longwall Shearers by Confining the Dust Cloud to the Face" by Kissell et al, Tech Progress Report 111, Feb. 1981, of the Bureau of Mines Respiratory Dust Control Program, rely upon the use of passive barriers and water sprays to contain the dust. This article specifically describes dividing the air flow around the shearer into a clean air flow and a contaminant air flow by means of a passive barrier. The contaminant air flow is used to confine the dust cloud to the vicinity of the coal face while the shearer operators remain in the clean air flow on the opposite side of the machine. The air flow is improved by the use of water sprays that move the air like a small fan and can be positioned to direct the dusty air toward the coal face. A similar system is described in Report of Investigations 9037, Bureau of Mines, entitled "Using Barriers to Reduce Dust Exposure of Longwall Face Workers" by Robert A Jankowski and Charles A Babbitt. This report also describes the use of passive barriers for directing the air flow past the shearer in two streams; one stream being the clean air flow which is directed toward the shearer operators, the other air flow being directed to contain the dust cloud to the coal face. The report also refers to the above-referenced article for the suggestion that water sprays increase the effectiveness of the air flow in confining the dust cloud to the coal face. Similar descriptions of passive barriers are described in Technology News Releases, from the Bureau of Mines, US Department of the Interior, No. 116, Nov. 1981, "Modified Cutting Sequence Reduces Longwall Shearer Operators, Dust Exposure"; No. 119, Nov. 1981, "Reduce Dust on Longwall Faces with a Gob Curtain"; No. 121, Dec. 1981, "Spring-Mounted Screens on Shearer Reduce Operators, Dust Exposure"; No. 137, Mar. 1982, "Ventilation Curtain Reduces Dust from Cutting into Longwall Entry" and No. 205, Aug. 1984, "Reducing Longwall Face Workers, Respirable Dust Exposure from Roof Support Movement". All of these releases describe the use of passive barriers for directing the air flow in an attempt to confine the dust to the coal face. The reports also describe the use of water sprays to increase the effectiveness of the air flow in confining the dust cloud to the coal face. The water sprays all use conventional pressure spray nozzles that utilize pressurized water to produce the spray.

All of the above systems rely on passive barriers, either with or without the use of water sprays in an attempt to confine the dust cloud to the coal face. From the data described in the reports, none of these systems are effective in maintaining the dust level in a longwall shearer operation below the 2 milligram per cubic meter level set by the Bureau of Mines. The systems also require a large quantity of water when water sprays are used which presents the problem of supplying the water to the mine as well as disposing of the water in the mine.

SUMMARY OF THE INVENTION

The present invention solves the above problems by an entirely different approach. In particular, the present invention does not rely upon the use of passive barriers and water sprays for directing the air flow over the shearer in order to confine the dust cloud to the coal face. Instead, the present invention utilizes small scrubbing units mounted on the shearers for removing the dust from the air flow. The scrubbers are wet scrubbers in which a fine water mist is used to remove the dust particles from the air. The dust-containing mist is then discharged onto the coal face. The scrubbers are so positioned that they will draw the dust cloud from the rotating drums of the shearer, remove the dust and direct the air containing the water mist and captured dust back toward the longwall coal face.

The wet scrubbers are of a particular design using twin fluid atomizers for forming the water mist. The use of twin fluid atomizers provides an economical means for producing a mist having particles in the size of 1 to 50 microns. This size particle is most effective in removing dust particles from air. The twin fluid atomizers utilize compressed air as one fluid and water as the second fluid. As a result of the effectiveness of the atomizers in producing the small particle size a minimum amount of water is required for operating the scrubber. This greatly reduces the amount of water that must be supplied to the mine as well as disposed in the mine. In addition to providing the water mist for removing the dust from the air, the twin fluid atomizers are designed to supply sufficient momentum to induce an air flow through the scrubber and direct the discharge onto the coal face. Thus, the scrubbers do not require any fans or other apparatus for moving the air from the rotating drum through the scrubber and directing it onto the coal face.

In addition to the scrubbers, the invention also includes a series of twin fluid atomizers that are positioned on one of the ranging arms of the miner. The series of nozzles are disposed to travel with a ranging arm and direct the dust produced by the cutting drum associated with the ranging arm back toward the coal face. Additional twin fluid atomizers are mounted on the end of the roof shield adjacent the access gallery. This series of nozzles is only used when the drum cutter is breaking through the wall of the gallery. Under these conditions considerable dust is produced that is carried by the ventilation air flow into the lateral coal seam in which the miner is operating.

BRIEF DESCRIPTION OF THE DRAWINGS

The present invention will be more easily understood from the following detailed description when taken in conjunction with the attached drawings in which:

FIG. 3 is an end view of the shearer with the roof shield in place.

FIG. 4 is a plan view shown partially in section of a scrubber unit of the present invention.

FIG. 5 is a cross section of the scrubber taken along lines 5—5 of FIG. 4.

DESCRIPTION OF PREFERRED EMBODIMENTS

Figure 1:
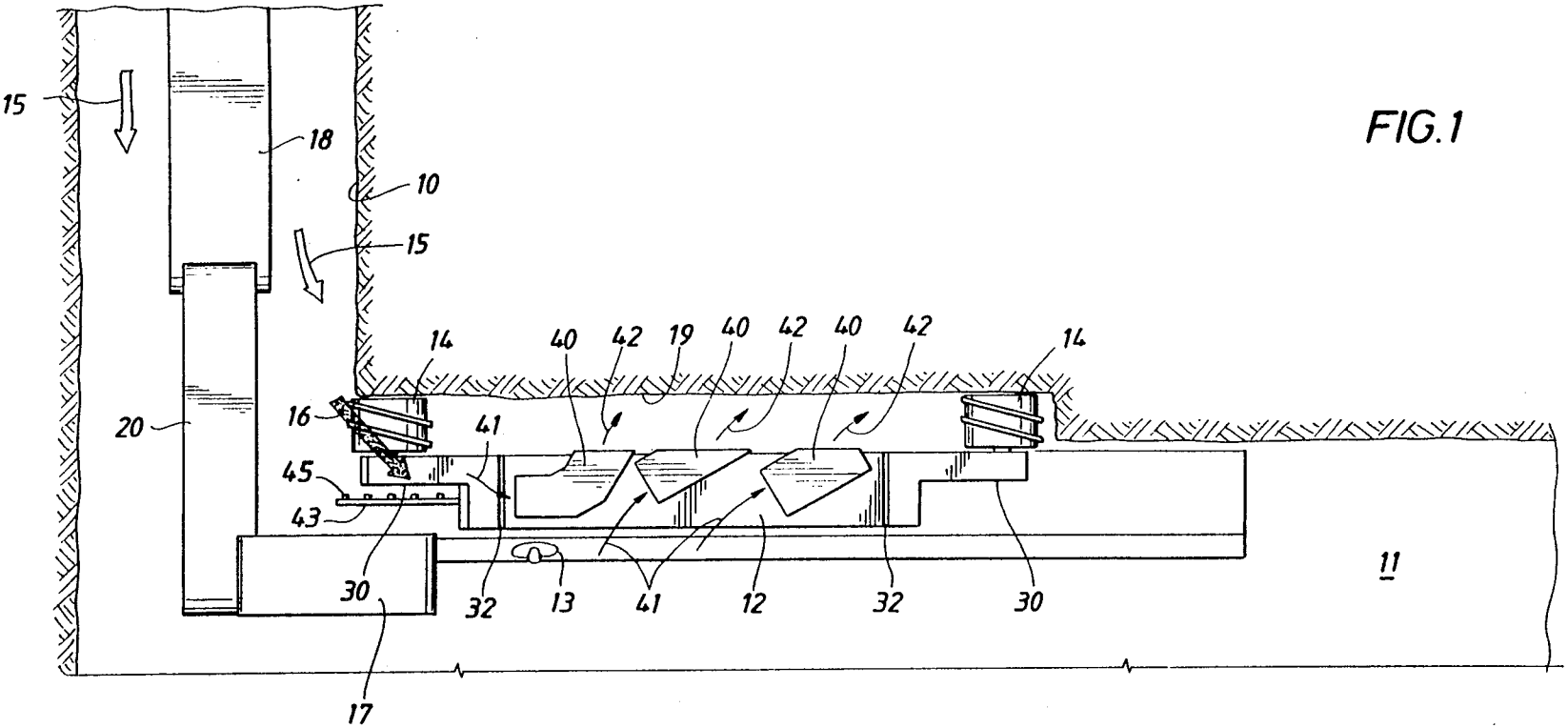
FIG. 1 is a plan view of a typical mine showing the operation of a longwall shearer without dust control.

Referring to FIG. 1, there is shown a longwall shearer 12 positioned in lateral coal seam 11 extending off a gallery 10 that provides access to the coal seam. The shearer 12 is shown in a position where it has completed cutting coal from the coal face 19 in one direction and started cutting coal from the coal face while moving in a direction from left to right as shown in the Figure. The shearer is operated by operators 13 that are positioned on the gob side of the shearer. The coal removed from the coal face 19 by the shearer is conveyed by conveyor 17 to stage loading device 20 which loads the coal onto conveyor that transports the coal through the gallery to the surface.

The ventilation air flow is illustrated by arrows 15 and is supplied by suitable fans or other equipment at the surface. The air flow advances down the gallery and turns into the lateral coal seam 11 as shown by shaded arrow 16 carrying the dust into the lateral coal seam. As shown by shaded arrow 16, as the air flow passes over drum 14 at the end of the shearer it is contaminated by the dust generated by the operation of drum 14. In the absence of any control, this dust-laden air will pass directly over operators 13 as shown. It is obvious that some means must be provided for either removing the dust from the air flow or redirecting the air flow back toward the longwall face 19 of the coal seam 11.

Figure 2:
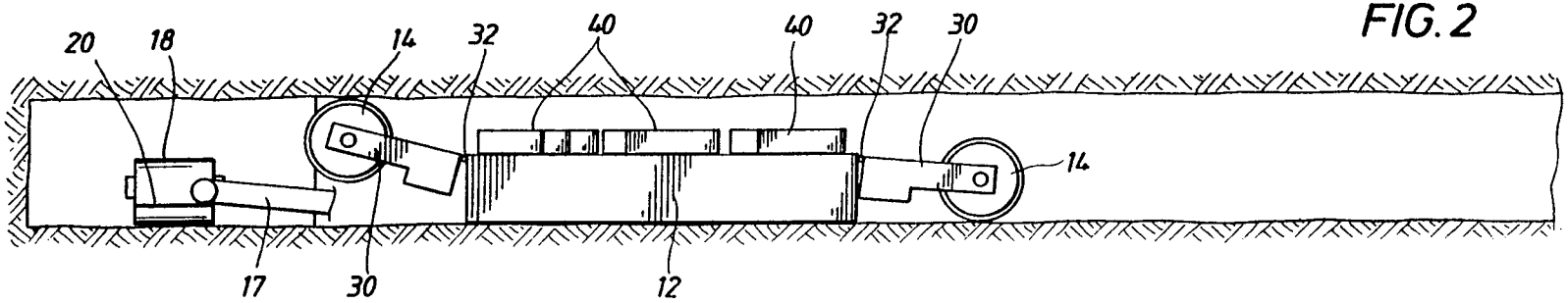
FIG. 2 is a front view of the longwall shearer shown in FIG. 1.

Referring now to FIGS. 2 and 3 there is shown an end view and a front view of the longwall shearer 12 similar to the one shown in FIG. 1 including the wet scrubbers of the present invention. As shown in Figures, the longwall shearer is provided at opposite ends with rotating drums 14 referred to as the head and tail drums, depending upon which direction the shearer is moving. One of the drums is elevated to cut the coal at the top of the sea while the other drum is depressed to cut the coal at the bottom of the seam. The difference in elevation between the drums depends upon the overall thickness of the coal seam. The mine is equipped with shield 21 which supports mine roof 22 over the top of the shearer as shown in FIG. 3. As the shearer advances to cut additional coal, shield 21 is moved forward to support mine roof Shearer 12 is a conventional shearer in which cutting drums 14 are mounted on ranging pivotal arms 30 that pivot about axes 32. The drums are driven by suitable motors (not shown) while additional motors (not shown) are provided for moving the shearer along coal face 11.

Shearer 12 is equipped with a plurality of wet scrubbers 40 (three of which are shown in the Figures), a spray box 44 mounted on the end of the shield 21 adjacent the gallery 10 and a spray bar 43 mounted parallel to one of the ranging arms 30. The number and size of wet scrubbers utilized will depend upon the space available for installing the scrubbers, i.e., the maximum overall height of shearer 12. Also, in cases where large quantities of dust must be removed from the air, additional scrubbers may be required. As shown in the Figures, the scrubbers draw air from the vicinity of cutter drum 14 adjacent the end of the shearer closest to the gallery 10 into the inlet side of the scrubbers as illustrated by arrows 41. The air including the water mist and entrained dust is discharged onto the coal face as shown by arrows 42.

In addition to the three scrubbers described above, a separate spray header enclosed in a rectangular box 44 is attached beneath the roof shield 21 adjacent the gallery end of the shield for entraining dusty air during headgate cutout. The spray header is provided with three spray nozzles that produce a flat spray pattern. A flat spray pattern is more effective than a round pattern in producing an air flow. The headgate cutout refers to the cutting of the wall of the gallery 10 when the miner is travelling from left to right or counter to the air flow as shown in FIGS. 1 and 2. The spray nozzles are positioned to effectively re-direct the dusty air toward the coal face, thus preventing dust spill-over on the operators during this particular phase of the operation.

The spray bar 43 is used to continuously scrub the shearer-generated dust and to re-direct dusty air toward the coal face. The spray bar 43 has five twin-fluid nozzles built into it and is attached to the ranging arm 30 in a parallel arrangement. The front or loading nozzle 45 has multi-holes and is directed at the shearer drum in order to scrub the dust at the source. The remaining four nozzles are designed to produce a flat spray pattern to effectively entrain and re-direct the dusty air pattern toward the coal face and prevent dust spill-over.

The use of twin fluid atomizers in place of the pressure nozzles disclosed in the prior art significantly reduces the quantity of water used in dust control. For example, the three twin fluid atomizers used in the spray box 44 require two gallons per minute and 70 cfm of air, both at 100 psi, to produce an air flow of 5000 cfm. In contrast, pressure nozzles require twenty five gallons per minute to produce the same air flow. This tenfold reduction in the water required reduces both the cost of supplying the water and the cost of disposing of the water.

Referring now to FIGS. 4 and 5 there is shown the detailed construction of the twin fluid scrubbers shown in FIGS. 1–3. These scrubbers are more particularly described and claimed in Applicants' U.S. Pat. No. 5,039,315, incorporated herein by reference. Scrubbers 40 consist of a rectangular duct work. As explained in the '315 patent, the mist supplied by twin fluid atomizers 53 completely fills the cross sectional area of the duct work. This ensures that all the dust-laden air drawn into opening 50 will pass through the water mist. Twin fluid atomizers 53 are mounted on a suitable pipe 55 which, in addition, supplies one of the fluids to the atomizers, for example, the compressed air. The second fluid is supplied to the atomizers through separate pipe 56 and is preferably water. The atomizers supply a fine mist as illustrated by arrows 54 which expands to completely fill the cross sectional area of the duct work. In addition to providing a mist that has particles in the range of 1 to 50 microns, atomizers 53 produce an air flow through the duct work. The air flow is produced by the momentum of the mist supplied by the atomizers and is sufficient to draw the dust-laden air into inlet 50 and discharge it from outlet 52 onto coal face 11 as shown by arrows 42 in FIGS. 1 and 3.

The atomizers are sized to supply the necessary air handling capacity for removing the dust from the air flow air and maintaining the dust level below the 2 milligrams per cubic meter specified by the regulatory agencies. For example, the shearer shown in FIG. 2 is capable of cutting coal in a seam having a thickness of 9 feet or less. This particular shearer has an overall height of 46 inches while the cutting drums can be lowered until the overall height is 54.5 inches. Thus, it is possible to install wet scrubbers on top of the shearer having an overall height of 8 inches without reducing the operating capabilities of the shearer. In a particular mine, it was found sufficient to install three wet scrubbers having an overall height of 8 inches and a width of 36 inches. These scrubbers maintained the air quality below the minimum standards set by the regulatory agencies. Each scrubber was provided with four twin fluid atomizers that of 71 cubic feet of 90 psi compressed air and 2.75 gallons of water per minute to produce an air flow of 3250 cfm. In contrast, pressure nozzles would require 25 gallons of water per minute for the same air flow. Further, the pressure nozzles would not produce a droplet size of 1 to 50 microns which size is most effective in removing dust particles. The scrubbers were positioned as shown in the drawings and maintained the air quality in the operator's area at or below the standard of 2 milligrams of dust per cubic meter. Obviously, in other mines and with other shearers, it may be necessary to use a different number of wet scrubbers having smaller overall dimensions. When the size of the scrubbers is increased, it would be necessary to use additional scrubbers to provide the necessary air handling capacity for maintaining the dust level at the desired levels.

What is claimed:

1. An air scrubbing system for removing dust produced by longwall shearers from the operator's work area, said shearer having at least one rotating drum for shearing coal from said longwall coal face, said scrubbing system comprising:

at least one scrubbing unit comprising a duct means disposed to form a confined flow path, said unit being mounted on said shearer and disposed to draw dust-laden air from the work area and discharge the dust-laden air toward the coal face; and at least one twin fluid atomizer, said atomizer being disposed at the inlet of the scrubbing unit to produce a mist wherein the liquid drops have a size range between 1 and 50 microns, said atomizer in addition being directed to produce an air flow from the work area through the scrubber and discharge the dust-laden air toward the coal face.

2. The scrubbing system of claim 1 and, in addition, a spray bar, said spray bar having at least one twin fluid atomizer, said atomizers being arranged to draw air from the work area and direct it toward said at least one rotating drum.

3. The scrubbing system of claim 2 and, in addition, mounting said at least one rotating drum on a ranging arm and mounting said spray bar on said ranging arm and parallel thereto.

4. The scrubbing system of claim 1 and, in addition, a roof support shield position to support the mine roof over the top of the shearer, a spray means disposed in said shield adjacent one end of the longwall coal face.

5. The scrubbing system of claim 4 and, in addition, a spray bar, said spray bar having at least one twin fluid atomizer disposed thereon, said spray bar in addition being mounted adjacent said rotating drum and arranged to draw air from the work area and direct it toward said rotating drum.

6. The scrubbing unit of claim 1 and, in addition, a second rotating drum, one of said rotating drums being mounted on a ranging arm disposed at the other of said rotating drums being mounted at one end of the shearer on a ranging arm disposed at the opposite end of the shearer.

7. The scrubbing unit of claim 6 wherein said longwall coal face extends substantially laterally from an access gallery.

8. The scrubbing unit of claim 7, and, in addition, a spray bar having at least one twin fluid atomizer, said spray bar being mounted on the ranging arm nearest said access gallery.

9. A method for removing the dust from the operator'work area of a longwall shearer, said shearer having at least one rotating drum for shearing coal from the longwall coal face, said method comprising:

producing a water mist having a particle size between 1 and 50 microns using water plus a compressed gas;

directing said water mist along a confined path to induce an air flow along the path from one end toward the other end; and positioning said path so that dust-laden air is drawn from the operator's work area into said one end of the path and discharged from the other end of the path adjacent the longwall coal face.

* * * * *